US012134846B2

(12) United States Patent
Habraken et al.

(10) Patent No.: US 12,134,846 B2
(45) Date of Patent: Nov. 5, 2024

(54) NONWOVEN FABRIC

(71) Applicant: BASF SE, Ludwigshafen am Rhein (DE)

(72) Inventors: Gijsbrecht Jacobus Maria Habraken, Ludwigshafen am Rhein (DE); Klaus Scheuermann, Ludwigshafen am Rhein (DE); Gabriel Skupin, Ludwigshafen am Rhein (DE); Jens-Uwe Schierholz, Ludwigshafen Am Rhein (DE)

(73) Assignee: BASF SE, Ludwigshafen am Rhein (DE)

( * ) Notice: Subject to any disclaimer, the term of this patent is extended or adjusted under 35 U.S.C. 154(b) by 668 days.

(21) Appl. No.: 17/436,267

(22) PCT Filed: Mar. 5, 2020

(86) PCT No.: PCT/EP2020/055769
§ 371 (c)(1),
(2) Date: Sep. 3, 2021

(87) PCT Pub. No.: WO2020/178363
PCT Pub. Date: Sep. 10, 2020

(65) Prior Publication Data

US 2022/0162788 A1 May 26, 2022

(30) Foreign Application Priority Data

Mar. 7, 2019 (EP) ..... 19161276

(51) Int. Cl.
*D04H 3/011* (2012.01)
*D04H 3/147* (2012.01)
*D04H 3/16* (2006.01)

(52) U.S. Cl.
CPC ..... *D04H 3/011* (2013.01); *D04H 3/147* (2013.01); *D04H 3/16* (2013.01)

(58) Field of Classification Search
None
See application file for complete search history.

(56) References Cited

U.S. PATENT DOCUMENTS

| | | | |
|---|---|---|---|
| 6,582,818 | B2 | 6/2003 | Haile et al. |
| 2012/0156461 | A1 | 6/2012 | Krishnamurthy |
| 2012/0180232 | A1 | 7/2012 | Baum et al. |

FOREIGN PATENT DOCUMENTS

| | | | |
|---|---|---|---|
| WO | 2011/012598 | A1 | 2/2011 |
| WO | 2018/219708 | A1 | 12/2018 |

OTHER PUBLICATIONS

International Search Report and Written Opinion received for PCT Patent Application No. PCT/EP2020/055769, mailed on May 20, 2020, 10 pages.
European Search Report for EP Patent Application No. 19161276.1, Issued on Aug. 19, 2019, 3 pages.
Stibal et al., "Fibers, 3. General Production Technology", Ullmann's Encyclopedia of Industrial Chemistry, ed. Ley, et al., Sep. 15, 2001, pp. 1-68.

*Primary Examiner* — Arti Singh-Pandey
(74) *Attorney, Agent, or Firm* — Faegre Drinker Biddle & Reath LLP

(57) ABSTRACT

The present invention relates to a nonwoven fabric comprising continuous spunbonded bicomponent fibers which consist of: 0 to 95% by weight of an aromatic polyester (A) in a core; to 50% by weight of a polyester blend (B) containing a) 65 to 95% of an aromatic polyester (BA) and b) 5 to 35% by weight of an aliphatic-aromatic polyester (BB) with a glass temperature below 0° C. in a sheath surrounding the core; and 0 to 5% by weight of at least one additive (C); wherein the % by weight are based in each case on the total weight of the components (A) and (B) and optionally (C); and wherein the aromatic polyesters (A) and (BA) are selected from the group consisting of poly(ethylene terephthalate) and poly(butylene terephthalate).

5 Claims, No Drawings

NONWOVEN FABRIC

CROSS-REFERENCE TO RELATED APPLICATIONS

This application is a national stage application (under 35 U.S.C. § 371) of PCT/EP2020/055769, filed Mar. 5, 2020, which claims benefit of European Application No. 19161276.1, filed Mar. 7, 2019, both of which are incorporated herein by reference in their entirety.

DESCRIPTION

The present invention relates to a nonwoven fabric comprising continuous spunbonded bicomponent fibers which consist of:

50 to 95% by weight of an aromatic polyester (A) in a core;

5 to 50% by weight of a polyester blend (B) containing:

a) 65 to 95% of an aromatic polyester (BA) and b) 5 to 35% by weight of an aliphatic-aromatic polyester (BB) with a glass temperature below 0° C.

in a sheath surrounding the core; and 0 to 5% by weight of at least one additive (C);

wherein the % by weight are based in each case on the total weight of the components (A) and (B) and optionally (C); and wherein the aromatic polyesters (A) and (BA) are selected from the group consisting of poly(ethylene terephthalate) and poly(butylene terephthalate).

U.S. Pat. No. 6,582,818 discloses staple fibers with a core based on aromatic polyesters and a sheath based on pure aliphatic-aromatic polyesters. The lower length of staples fibers in comparison to continuous spunbonded fibers generally leads to a weaker strength of the so formed nonwovens.

US 2012/0156461 discloses bicomponent fibers with a poly(ethylene terephthalate) (PET) core and a poly(trimethylene terephthalate) (PTT) sheath. Both core and sheath may contain up to 15% by weight of an aliphatic-aromatic polyester. The mechanical properties of these fibers with similar content of an aliphatic-aromatic polyester in core and sheath showed disadvantages.

The objective technical problem underlying the present invention is therefore that of providing nonwoven fabric comprising continuous spunbonded bicomponent fibers which show improved mechanical behaviour such as higher tensile strength or elongation at break.

This object is achieved by a nonwoven fabric comprising continuous spunbonded bicomponent fibers which consist of:

50 to 95% by weight of an aromatic polyester (A) in a core;

5 to 50% by weight of a polyester blend (B) containing:

a) 65 to 95% of an aromatic polyester (BA) and b) 5 to 35% by weight of an aliphatic-aromatic polyester (BB) with a glass temperature below 0° C. in a sheath surrounding the core; and 0 to 5% by weight of at least one additive (C);

wherein the % by weight are based in each case on the total weight of the components (A) and (B) and optionally (C); and wherein the aromatic polyesters (A) and (BA) are selected from the group consisting of poly(ethylene terephthalate) and poly(butylene terephthalate).

The invention is explained in more detail hereinafter.

The term nonwoven fabric is used interchangeably with nonwoven sheet, nonwoven web or nonwoven layer. The term nonwoven means a manufactured sheet, web or layer of randomly oriented fibers or filaments to form a planar material without a geometrical pattern.

The nonwoven fabrics are preferably prepared using a direct lay-down process. Direct laydown means spinning and collecting individual fibers directly into a fabric without winding filaments on a package or collecting a tow or cutting the fiber.

The term spunbonded fiber as used herein means fibers that are formed by extruding molten thermoplastic polymer material as fibers from a plurality of fine, usually circular, capillaries of a spinneret with the diameter of the extruded fibers then being rapidly reduced by drawing and then quenching the fibers. Other fiber cross-sectional shapes such as oval, multi-lobal, etc. can also be used.

Spunbonded fibers are generally continuous and usually have an average diameter of greater than about 5 micrometers. Spunbonded nonwoven fabrics are formed by laying fibers randomly on a collecting surface such as a foraminous screen or belt and spunbonding the fibers by methods known in the art such as by hot-roll calendering or by passing the fabric through a saturated-steam chamber at an elevated pressure. For example, the nonwoven fabric can be thermally point bonded at a plurality of thermal bond points located across the nonwoven web.

As used herein, the term bicomponent fiber refers to a fiber comprising a pair of polymer compositions intimately adhered to each other along the length of the fiber, so that the fiber cross-section is sheath-core. The bicomponent sheath/core polymeric fibers can be round, trilobal, pentalobal, octalobal, dumbbell-shaped, island-in-the-sea or otherwise star shaped in cross section.

As used herein, the term continuous fiber refers to a fiber of indefinite or extreme length. In practice, there could be one or more breaks in the continuous fiber due to manufacturing process, but a continuous fiber is distinguishable from a staple fiber which is cut to a predetermined length.

The nonwoven web disclosed herein comprises a plurality of continuous spunbonded bicomponent fibers in a sheath-core configuration. The weight ratio between the sheath component and the core component of the disclosed spunbonded bicomponent fibers is 0.05 to 1:1 to 19 and preferred from 0.4 to 0.7:1.5 to 2.5. The bicomponent fibers have an average fiber diameter in the range of 2 microns to 40 microns. In an embodiment, each bicomponent fiber comprises 80 to 99%, by weight, preferably 85 to 95%, by weight of aromatic polyester (A) and (BA) in the fiber and 1 to 20%, preferably 5 to 15%, by weight of an aliphatic-aromatic polyester (BB) in the sheath surrounding the core. The content of the aliphatic-aromatic polyester (BB) in the sheath is usually 5 to 35% by weight and preferably from 15 to 30% by weight and the content of the aromatic polyester (BA) within the sheath component is usually from 65 to 95% by weight and preferably 70 to 85% by weight.

The continuous spunbonded bicomponent fibers according to the invention consist of:

50 to 95% by weight of an aromatic polyester (A) in a core;

5 to 50% by weight of a polyester blend (B) containing:

a) 65 to 95% of an aromatic polyester (BA) and b) 5 to 35% by weight of an aliphatic-aromatic polyester (BB) with a glass temperature below 0° C.

in a sheath surrounding the core; and 0 to 5% by weight of at least one additive (C);

wherein the % by weight are based in each case on the total weight of the components (A) and (B) and optionally (C); and wherein the aromatic polyesters (A) and (BA) are selected from the group consisting of poly(ethylene terephthalate) and poly(butylene terephthalate).

Aromatic polyester (A) and (BA)

Components (A) and (BA) are at least one terephthalate polyester.

In the bicomponent fibers according to the invention the amount of the at least one terephthalate polyester (A) and (BA) used is generally in the range of 80 to 99% by weight, preferably in the range of 85 to 95% by weight of the at least one terephthalate polyester (A), based on the total weight the components (A), (B) and optionally (C). spunbonded in order to obtain the nonwoven fabrics.

The terms "at least one terephthalate polyester", "terephthalate polyester", "terephthalate polyester" and "components (A) and (BA)" are used synonymously in the context of the present invention and have the same meaning. Furthermore, in the context of the present invention, the term "at least one terephthalate polyester" is understood to mean exactly one terephthalate polyester and mixtures of two or more terephthalate polyesters. In a preferred embodiment, exactly one terephthalate polyester (A) and (BA) is used in the process of the invention. Most preferred the components (A) and (BA) are the same terephthalate polyester.

The terephthalate polyester can be prepared by all methods known to those skilled in the art. In a preferred embodiment, the terephthalate polyester is prepared by polycondensation of diols, terephthalic acid compounds and optionally isophthalic acid compounds. In a preferred embodiment for the production of the terephthalate polyester no aliphatic dicarboxylic acid compound is used.

In a preferred embodiment the at least one terephthalate polyester is obtainable by polymerization of at least the following monomers:

(i1) at least one aliphatic diol, preferably ethane-1,2-diol or butane-1,4-diol and (i2) at least one terephthalate acid compound (i3) optionally at least one isophthalic acid compound.

The aliphatic diol (i1) can be linear, branched or cyclic and is an aliphatic diol having 2 to 12, preferably having 2 to 6, more preferably 2 to 4 carbon atoms.

The aliphatic diols (i1) are usually ethylene glycol (ethane-1,2-diol) or butane-1,4-diol. Preferably the component (i1) used for the preparation of the terephthalate polyester consist of at least 95% by weigh, preferably at least 98% by weight of an diol selected from the group consisting of ethylene glycol and butane-1,4-diol and 0 to 5% by weight, preferably 0 to 2% by weight of at least one further diol, selected from the group consisting of propane-1,3-diol, pentane-1,5-diol, hexane-1,6-diol, diethylene glycol, triethyleneglycol, 2-methyl-1,3-propanediol, 2-ethyl-1,3-propanediol, 2,2-dimethylpropane-1,3-diol, 2-methyl-1,4-butanediol, 2-ethyl-2-butylpropane-1,3-diol, 2-ethyl-2-isobutylpropane-1,3-diol, 1,4-cyclohexandiol, cyclohexane-1,4-dimethanol and 2,2,4-trimethylhexane-1,6-diol.

Component (i2) is at least one terephthalic acid compound.

In the context of the present invention, terephthalic acid compound (i2) is understood to mean terephthalic acid itself and derivatives of terephthalic acid, such as terephthalic esters. Useful terephthalic esters here include the di-$C_1$-$C_6$-alkyl esters of terephthalic acid, for example the dimethyl, diethyl, di-n-propyl, diisopropyl, di-n-butyl, diisobutyl, di-t-butyl, di-n-pentyl, diisopentyl or di-n-hexyl esters of terephthalic acid. The same holds true for the optional isophthalic acid compound (i3), respectively.

The terephthalic acid or derivatives thereof may be used individually or as a mixture of two or more thereof. In view of component (i2) particular preference is given to using terephthalic acid or dimethyl terephthalate.

In view of the optionally used component (i3) particular preference is given to using isophthalic acid, dimethyl isophthalate, 5-sulfoisophthalic acid mono sodium salt or dimethyl 5-sulfoisophthalate mono sodium salt.

Usually terephthalate polyester is at least one polyester selected from the group consisting of poly(ethylene terephthalate) (PET) and poly(butylene terephthalate) (PBT). More preferred the components (A) and (BA) are both poly(butylene terephthalate) (PBT) and most preferred the components (A) and (BA) are both poly(ethylene terephthalate) (PET).

In the context of the present invention PET, in a preferred embodiment, is understood to mean a polyester that contains at least 95% by mol of repetition units derived from the above defined terephthalic acid compounds (i2) and ethylene glycol (i1), wherein the polyester may optionally contain 0 to 5% by mol of further repetition units, based on the total number of mols of repetition units contained in the polyester. The further repetition units contained in the PET may be derived from the above defined components (i3) and the above-mentioned components (i1), different from ethylene glycol.

Suitable polyethylene terephthalates (PET) are for example available from the manufacturer Indorama ventures under the trade name RAMAPET. Moreover, recycled polyethylene terephthalates (PET), for example from the recycling of plastic bottles (bottle grade PET) or for example from post-consumer fibers and post-industrial fiber waste, are suitable.

The polyethylene terephthalate (PET) especially preferred in accordance with the invention as terephthalate polyester generally has a melting temperature ($T_M$) in the range from 220 to 280° C., preferably in the range from 230 to 270° C., determined by differential dynamic calorimetry (differential scanning calorimetry; DSC) at a heating and cooling rate of 10° C./min.

In the context of the present invention PBT, in a preferred embodiment, is understood to mean a polyester that contains at least 65% by mol, preferably at least 80% by mol, more preferably at least 90% by mol and most preferably at least 95% by mol of repetition units derived from the above defined terephthalic acid compounds (i2) and butane-1,4-diol (i1), wherein the polyester may optionally contain 0 to 35% by mol, preferably 0 to 20% by mol, more preferably 0 to 10% by mol and most preferably 0 to 5% by mol of further repetition units, based on the total number of mols of repetition units contained in the polyester. The further repetition units contained in the PBT may be derived from the above defined components (i3) and the above-mentioned components (i1), different from butane-1,4-diol.

Suitable polybutylene terephthalates (PBT) are for example available from the manufacturer BASF SE under the trade name Ultradur® B 2550. Moreover, recycled polybutylene terephthalates (PBT), for example from post-industrial fibers, are suitable.

The polybutylene terephthalate (PBT) preferred in accordance with the invention as terephthalate polyester generally has a melting temperature ($T_M$) in the range from 180 to 250° C., preferably in the range from 210 to 240° C., determined by differential dynamic calorimetry (differential scanning calorimetry; DSC) at a heating and cooling rate of 10° C./min.

For the preparation of the at least one terephthalate polyester (A) and (BA) used in accordance with the invention, typical reaction conditions and catalysts are known in principle to those skilled in the art.

Aliphatic-Aromatic Polyester (BB)

Component (BB) is at least one aliphatic-aromatic polyester as disclosed e.g. in WO 2011/012598 and WO 2018/219708.

Among the preferred polyesters BB are polyesters comprising, as essential components:

BB-a) from 30 to 70 mol %, preferably from 40 to 60 mol %, and with particular preference from 50 to 60 mol %, based on components BB-a) to BB-b), of a $C_4$ to $C_{18}$-aliphatic dicarboxylic acid or a mixture thereof, preferably as follows: succinic acid, adipic acid, azelaic acid, sebacic acid, and brassylic acid, BB-b) from 30 to 70 mol %, preferably from 40 to 60 mol %, and with particular preference from 40 to 50 mol %, based on components BB-a) to BB-b), of an aromatic dicarboxylic acid or a mixture thereof, preferably as follows: terephthalic acid, BB-c) from 98.5 to 100 mol %, based on components BB-a) to BB-b), of 1,4-butanediol and 1,3-propanediol; and BB-d) from 0 to 1% by weight, preferably from 0.1 to 0.2% by weight, based on components BB-a) to BB-c), of a chain extender, in particular of a di- or polyfunctional isocyanate, preferably hexamethylene diisocyanate, and optionally of a branching agent, preferably: trimethylolpropane, pentaerythritol, and in particular glycerol.

Aliphatic diacids and the corresponding derivatives BB-a that can be used are generally those having from 4 to 18 carbon atoms, preferably from 6 to 10 carbon atoms. They can be either linear or branched compounds. However, it is also in principle possible to use dicarboxylic acids having a larger number of carbon atoms, by way of example having up to 30 carbon atoms.

Examples that may be mentioned are: succinic acid, 2-methylglutaric acid, 3-methylglutaric acid, a -ketoglutaric acid, adipic acid, pimelic acid, azelaic acid, sebacic acid, brassylic acid, suberic acid, and itaconic acid. The dicarboxylic acids or ester-forming derivatives thereof can be used here individually or in the form of a mixture of two or more thereof.

It is preferable to use succinic acid, adipic acid, azelaic acid, sebacic acid, brassylic acid, or respective ester-forming derivatives of these, or a mixture thereof. It is particularly preferable to use adipic acid or sebacic acid, or respective ester-forming derivatives of these, or a mixture thereof.

The aromatic dicarboxylic acids BB-b or ester-forming derivatives of these can be used individually or in the form of a mixture of two or more thereof. It is particularly preferable to use terephthalic acid or its ester-forming derivatives such as dimethyl terephthalate.

A general procedure uses from 0 to 1.5% by weight, preferably from 0.1 to 1.0% by weight, and with particular preference from 0.1 to 0.3% by weight, based on the total weight of the polyester, of a branching agent and/or from 0.05 to 1% by weight, preferably from 0.1 to 1.0% by weight, based on the total weight of the polyester, of a chain extender (BB-d). Preferred branching agents and chain extenders (BB-d) are selected from the group consisting of: a polyfunctional isocyanate, isocyanurate, oxazoline, carboxylic anhydride such as maleic anhydride, epoxide (in particular an epoxy-containing poly(meth)acrylate), an at least trihydric alcohol, and an at least tribasic carboxylic acid. One embodiment of the invention uses no branching agents, or no chain extenders.

Examples of suitable bifunctional chain extenders BB-d) are tolylene 2,4-diisocyanate, tolylene 2,6-diisocyanate, diphenylmethane 2,2'-diisocyanate, diphenylmethane 2,4'-diisocyanate, diphenylmethane 4,4'-diisocyanate, naphthylene 1,5-diisocyanate, or xylylene diisocyanate, hexamethylene 1,6-diisocyanate, isophorone diisocyanate, or methylenebis(4-isocyanato-cyclohexane). Particular preference is given to isophorone diisocyanate and in particular to hexamethylene 1,6-diisocyanate.

Preferred branching agents BB-d) are an at least trihydric alcohol, or an at least tribasic carboxylic acid such as: tartaric acid, citric acid, malic acid, trimethylolpropane, trimethylolethane, pentaerythritol, polyether triols, glycerol, trimesic acid, trimellitic acid, trimellitic anhydride, pyromellitic acid, pyromellitic dianhydride or hydroxyisophthalic acid. Particularly preferred branching agents are trimethylolpropane, pentaerythritol, and even more preferred glycerol.

The number-average molar mass (Mn) of the polyesters BB is generally in the range from 5000 to 100 000 g/mol, in particular in the range from 10 000 to 75 000 g/mol, preferably in the range from 15 000 to 38 000 g/mol, their weight-average molar mass (Mw) being from 30 000 to 300 000 g/mol, preferably from 60 000 to 200 000 g/mol, and their Mw/Mn ratio being from 1 to 6, preferably from 2 to 4. Intrinsic viscosity is from 50 to 450 g/mL, preferably from 80 to 250 g/mL (measured in o-dichlorobenzene/phenol (ratio by weight 50/50)). Melting point is in the range from 85 to 150° C., preferably in the range from 95 to 130° C.

MVR (melt volume rate) is generally from 0.5 to 15 $cm^3$/10 min, preferably from 2 to 10 $cm^3$/10 min, in accordance with EN ISO 1133-1 DE (190° C., 2.16 kg weight). Acid numbers are generally from 0.01 to 1.2 mg KOH/g, preferably from 0.01 to 1.0 mg KOH/g, and with particular preference from 0.01 to 0.7 mg KOH/g, in accordance with DIN EN 12634.

Component (C)

Component (C) is at least one additive.

In the bicomponent fibers according to the invention the amount of the at least one additive (C) used is generally in the range of 0 to 5% by weight, preferably in the range of 0 to 1.5% by weight of the at least one additive, based on the total weight the components (A), (B) and optionally (C) mixed in order to obtain a nonwoven fabric.

The terms "at least one additive (C")", "additive (C)", "additive" and "component (C)" are used synonymously in the context of the present invention and have the same meaning. In addition, in the context of the present invention, the term "at least one additive" is understood to mean exactly one additive and mixtures of two or more additives.

Suitable additives (C) are known to those skilled in the art.

Examples of additives are lubricants, nucleating agents, compatibilizers, flame retardants, reinforcing materials, plasticizers, antioxidants, UV stabilizers, mineral fillers and pigments.

In the context of the present invention, preference is given to using lubricants, nucleating agents and/or compatibilizers.

Useful lubricants or else mold release agents have been found to be especially hydrocarbons, fatty alcohols, higher carboxylic acids, metal salts of higher carboxylic acids, such as calcium stearate or zinc stearate, fatty acid amides, such as erucic acid amide, and wax types, for example paraffin waxes, beeswaxes or montan waxes. Preferred lubricants are erucic acid amide and/or wax types, and more preferably combinations of these lubricants. Preferred wax types are bee waxes and ester waxes, especially glycerol monostearate or dimethylsiloxane or polydimethylsiloxane, for example Belzil and DM® from Waga. By virtue of the addition of the lubricants prior to the chain extension, it is possible to partly bind the lubricants to the polymer chain. In this way, it is possible to effectively prevent premature exudation of lubricants out of the finished polymer compound.

Useful nucleating agents generally include inorganic compounds such as talc, chalk, mica, silicon oxides or barium sulfate. In the production of the polyester fibers (PF) of the invention, aromatic polyesters in particular, such as polyethylene terephthalate and especially polybutylene terephthalate, have been found to be advantageous.

Synthetic fibers are made from melt spinning processes or through solvent-based spinning processes. The fibers are drawn to optimize mechanical properties and subsequently texturized or twisted to create yarns. (Ullmann's Encyclopedia of Industrial Chemistry, Chapter fibers, 3. General Production Technology, DOI: 10.1002/14356007.a10 511)

Nonwovens can be made directly from endless fiber in spunbond or meltblown processes.

Spunbonded and meltblown nonwovens are made through a direct extrusion of the synthetic polymer to a fiber that is collected on a moving surface. (Encyclopedia of Polymer Science and Technology, Vol 10. p.578-613)

The meltblown process makes very fine fibers (1-5 μm) by blowing hot air at a high speed directly at the spinneret where the fiber melt leaves the die. In the spunbonded process typically the fiber is spun at a great height from a belt. The spun fiber can be oriented through increasing the melt pressure. The mechanical properties of the nonwoven can be tuned by the elongation of the fiber and the speed of the belt below the fiber spinning block. By binding the fibers through different methods: e.g. needlepunch, thermal bonding the stress-stain relationship can be modified.

Applications for PET and PBT in nonwovens are hygiene articles, medical articles, wipes (personal, household, industrial), interlinings, coating substrates, table linen/upholstery bedding, floor coverings, air and liquid filtration, construction materials, civil engineering/ geotextiles, automotive, agricultural nonwoven textiles. PBT as fiber material is specifically useful for applications where higher temperature resistance is required such as hot air filters.

EXAMPLES

Measurement of Physical Properties

Directly after the nonwoven was produced samples were cut for mechanical testing and weight determination. The strips for the tensile and elongation at break had a 5 cm width.

Mechanical testing for tensile strength and elongation at break: Strips of the nonwoven in the machine direction (MD) and in the direction were cut and cross-machine direction measured (ISO 9073-3).

Determining weight of nonwoven: The mass of the nonwoven is determined as gram per square meter (ISO 9073-1).

Starting Materials:

Aromatic polyester (components A and BA):

PET type 5520 from Invista with an intrinsic viscosity (IV) of 0.66 was used. The PET was dried at 160° C. to a moisture content of less than 50 ppm.

Aliphatic-aromatic polyester (component BB):

Polyester BB consisting of the monomers 1,4-butanediol (50 mol %), adipic acid (25 mol %) and terephthalic acid (25 mol %) was used. The polyester BB was dried at 70° C. overnight before use to a moisture content below 100ppm. The melt volume rate (MVR) of the used polyester was measured at 190° C., 2.16 kg. The MVR (190° C., 2.16 kg) for polyester BB was 3,4 ml/10 min.

TABLE 1

| Experiment number: | ST1 | CE1 | CE2 | CE3 | 1 | 2 | ST2 | 3 | ST3 | 4 |
|---|---|---|---|---|---|---|---|---|---|---|
| Core: PET wt % | 100 | 96 | 93 | 90 | 100 | 100 | 100 | 100 | 100 | 100 |
| Core: Polyester BB wt % | — | 4.0 | 7.0 | 10.0 | — | — | — | — | — | — |
| Sheath: PET wt % | 100.0 | 96.0 | 93.0 | 90.0 | 80 | 70 | 100.0 | 95.0 | 100.0 | 80 |
| Sheath: Polyester BB wt % | — | 4.0 | 7.0 | 10.0 | 20.0 | 30.0 | — | 5 | — | 20.0 |
| Spinneret number | 1 | 1 | 1 | 1 | 1 | 1 | 2 | 2 | 1 | 1 |
| Throughput per hole (g/min · hole) | 1.1 | 1.1 | 1.1 | 1.1 | 1.1 | 1.1 | 1.69 | 1.69 | 1.1 | 1.1 |
| Line speed (m/min) | 48.0 | 50.0 | 50.0 | 52.0 | 52.0 | 52.0 | 106 | 106 | 95.0 | 104.0 |
| Throughput ratio core:sheath | 65:35 | 65:35 | 65:35 | 65:35 | 65:35 | 65:35 | 65:35 | 65:35 | 65:35 | 65:35 |
| Melt temperature die core (° C.) | 297 | 291 | 291 | 288 | 288 | 289 | 286 | 286 | 297 | 288 |
| Melt temperature die sheath (° C.) | 299 | 291 | 290 | 279 | 287 | 283 | 287 | 287 | 299 | 285 |
| Heat roll #1: Oil temperature (° C.) | 255 | 245 | 245 | 245 | 245 | 240 | 255 | 250 | 255 | 245 |
| Heat roll #2: Oil temperature (° C.) | 253 | 243 | 243 | 243 | 243 | 238 | 253 | 248 | 253 | 243 |
| Tensile strength MD (N) | 311.1 | 235.9 | 230.2 | 245.9 | 451.2 | 402.9 | 107.4 | 119.7 | 174.0 | 223.2 |
| Tensile strength CD (N) | 90.8 | 63.9 | 64.1 | 78.0 | 222.1 | 238.2 | 57.0 | 65.1 | 55.4 | 97.4 |
| Elongation MD (%) | 33.3 | 28.7 | 32.3 | 37.7 | 72.2 | 67.3 | 27.6 | 38.3 | 34.6 | 23.6 |
| Elongation CD (%) | 33.6 | 35.2 | 39.8 | 48.3 | 71.6 | 62.0 | 38.2 | 45.1 | 40.8 | 58.6 |
| Fabric weight (g/m$^2$) | 109.4 | 106.3 | 100.9 | 101.7 | 103.2 | 104.3 | 51.3 | 49.8 | 56.9 | 56.3 |
| Improvement to comparison sample | | ST1 | ST1 | ST1 | ST1 | ST1 | | ST2 | | ST3 |
| Improvement tensile MD (%) | | −24% | −26% | −21% | 45% | 30% | | 11% | | 28% |
| Improvement tensile CD (%) | | −30% | −29% | −14% | 145% | 162% | | 14% | | 76% |
| Improvement elongation MD (%) | | −14% | −3% | 13% | 117% | 102% | | 39% | | −32% |
| Improvement elongation CD (%) | | 5% | 18% | 44% | 113% | 85% | | 18% | | 44% |

Preparation of spunbonded bicomponent fiber and nonwoven fabric formed therefrom:

The materials were dosed to twin-screw extruders. Both the sheath and the core composition are parallel prepared in separate twin-screw extruders. The dried polyesters were added through separate feeders based on the determined weight percentages. Melt pumps ensured a constant pressure of the polymer melt to the spin pack. In the spin pack the separate melt flows are combined and oriented into a sheath-core die design. The spinnerets used had 4982 holes/m (Spinneret 1) or 3200 holes/m (Spinneret 2). The amount of material for the sheath and the core were kept constant. The core had 65% by weight of the fiber and the sheath was 35% by weight of the fiber. Standard samples (ST1, ST2, ST3) did not contain any polyester BB. Comparative example samples (CE1, CE2, CE3) did contain polyester BB in equal amounts in the sheath and core. For experiment numbers 1,2,3 and 4 the amount of polyester BB selectively added to the sheath. The total throughput of materials was kept constant in the range of 325-329 kg/h. per meter of spinneret. The die temperature was kept at 290° C., but the melt temperatures were also lower, especially for the blends with the higher mixing ratios. The fiber was quenched by air in two stages Q1: 50° C. with a throughput of 3.8-5.4 $m^3$/kg of fiber, throughput: and Q2: 25° C. with a throughput of 22-23 $m^3$/kg of fiber.

The spun fiber was collected on belt with air suction. The speed of the belt was altered to change the weight of the collected nonwoven. The collected nonwovens were subsequently thermo bonded by calendering between two rolls heated by oil. The heat bonded nonwovens were collected on spools (Table 1).

The invention claimed is:

1. A nonwoven fabric comprising continuous spunbonded bicomponent fibers which consist of:

50 to 95% by weight of an aromatic polyester (A) in a core;

5 to 50% by weight of a polyester blend (B) containing:

a) 65 to 95% of an aromatic polyester (BA) and b) 5 to 35% by weight of an aliphatic-aromatic polyester (BB) with a glass temperature below 0° C.

in a sheath surrounding the core; and 0 to 5% by weight of at least one additive (C);

wherein the % by weight are based in each case on the total weight of the components (A) and (B) and optionally (C); and wherein the polyesters (A) and (BA) are selected from the group consisting of poly(ethylene terephthalate) and poly(butylene terephthalate).

2. A nonwoven fabric according to claim 1, wherein the polyesters (A) and (BA) are both poly(ethylene terephthalate).

3. A nonwoven fabric according to claim 1, wherein the aliphatic-aromatic polyester (BB) comprises:

BB-a) 30 to 70 mol %, based on components BB-a bis BB-b, of a $C_4$-$C_{18}$-dicarboxylic acid;

BB-b) 30 to 70 mol %, based on components BB-a bis BB-b, of terephthalic acid;

BB-c) 98 to 100 mol %, based on components BB-a bis BB-b, of 1,3- propane diol or 1,4-butane diol;

BB-d) 0 to 1,5% by weight, based on components BB-a bis BB-c, of branching agent or chain extender.

4. A nonwoven fabric according to claim 1, wherein the fabric weight is in the range of 25 gsm to 400 gsm.

5. A nonwoven fabric according to claim 4, wherein the fabric weight is in the range of 50 gsm to 200 gsm.

* * * * *